US006308673B1

(12) United States Patent
Kobayashi

(10) Patent No.: US 6,308,673 B1
(45) Date of Patent: Oct. 30, 2001

(54) ENCLOSURE CHAMBER FOR A CAMSHAFT DRIVING ENDLESS FLEXIBLE MEMBER OF AN INTERNAL COMBUSTION ENGINE

(75) Inventor: Tosihiki Kobayashi, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/618,128

(22) Filed: Jul. 17, 2000

(30) Foreign Application Priority Data

Sep. 3, 1999 (JP) ..... 11-250787

(51) Int. Cl.[7] ..... F01M 9/10

(52) U.S. Cl. ..... 123/90.38; 123/90.12; 123/90.15; 123/90.17; 123/195 C; 123/198 E

(58) Field of Search ..... 123/90.12, 90.15, 123/90.16, 90.17, 90.31, 90.38, 198 E, 198 C, 193.5, 193.3

(56) References Cited

U.S. PATENT DOCUMENTS 4,508,072 * 4/1985 Takami ..... 123/195 C 6,155,218 * 12/2000 Line ..... 123/90.15

FOREIGN PATENT DOCUMENTS 10089023 7/1998 (JP) .

* cited by examiner

*Primary Examiner*—Thomas Denion
*Assistant Examiner*—Jaime Corrigan
(74) *Attorney, Agent, or Firm*—Arent, Fox, Kintner, Plotkin & Kahn, PLLC

(57) ABSTRACT

In an internal combustion engine having a hydraulic valve characteristic control mechanism for altering phase of a cam driving a suction valve and an oil pressure control valve for controlling pressure of working oil supplied to the valve characteristic control mechanism, a chain chamber comprising a case formed by an engine main body and a cover closing the case. The oil pressure control valve is attached to the engine main body surrounded by a timing chain. In order to position the oil pressure control valve outside of the chain chamber, the cover has an opening for inserting the oil pressure control valve and the case has an attachment section around the oil pressure control valve to which a whole marginal edge of the opening is touched in liquid-tight and fixed.

3 Claims, 4 Drawing Sheets

ENCLOSURE CHAMBER FOR A CAMSHAFT DRIVING ENDLESS FLEXIBLE MEMBER OF AN INTERNAL COMBUSTION ENGINE

BACKGROUND OF THE INVENTION

The present invention relates to an internal combustion engine having a valve characteristic control mechanism for altering operational characteristic of at least one of a suction valve and an exhaust valve driven by a cam provided on a camshaft, and a control valve for controlling pressure of working oil to be supplied to the valve characteristic control mechanism. Particularly, the present invention relates to an enclosure chamber in the internal combustion engine which encloses an endless flexible member such as chain or belt laid between the camshaft and a crankshaft for transmitting torque of the crankshaft to the camshaft to drive the camshaft.

Hitherto, an internal combustion engine having a valve characteristic control mechanism for altering operational characteristic of at least one of a suction valve and an exhaust valve driven by a cam provided on a camshaft supported on a cylinder head so as to rotate, and a control valve for controlling pressure of working oil to be supplied to the valve characteristic control mechanism has been known (Japanese Laid-Open Patent Publication No. 10-89023).

In this internal combustion engine, the control valve is constituted by an electro-magnetic solenoid valve and attached on a side surface of the cylinder head. Therefore, the control valve liable to be heated by electric current is cooled by the air to prevent excessive temperature rise, and since the control valve is positioned at a place not exposed to oil, an oil-proof control valve is unnecessary.

On the one hand, an internal combustion engine having an enclosure chamber for an endless flexible member such as chain or belt laid between the camshaft and the crankshaft to drive the camshaft by torque of the crankshaft which is formed by a case formed by an engine main body and a cover covering the case has been known.

In the internal combustion engine described in the above-mentioned Japanese publication, the control valve is projected from a side surface of the cylinder head, therefore arrangement of parts in the vicinity is restrained in order to avoid interference with the parts, and there is a room for improvement from a viewpoint of compactness of the engine. Further, the control valve is apt to vibrate owing to vibration transmitted from the cylinder head to exert a bad influence on operational performance of the control valve. Therefore, a control valve which is coped with the vibration and expensive must be used to cause high cost.

On the one hand, in the customary enclosure chamber, the cover vibrates owing to vibration transmitted from the engine main body and noise is generated.

SUMMARY OF THE ENGINE

The present invention has been accomplished in view of the foregoing, and an object of the invention is to make the internal combustion engine having a hydraulic valve characteristic control mechanism compact and restrain vibration of a cover of an enclosure chamber to reduce noise.

Another object of the present invention is to restrain vibration of the control valve owing to vibration of the engine main body, necessitate no expensive control valve coped with vibration, and reduce the cost.

The present invention provides an enclosure chamber for a camshaft driving endless flexible member of an internal combustion engine having a camshaft for driving an engine valve, a hydraulic valve characteristic control mechanism for altering operational characteristic of the engine valve, a control valve for controlling pressure of operating oil supplied to the valve characteristic control mechanism, and the camshaft driving endless flexible member laid between the camshaft and a crankshaft to transmit torque of the crankshaft to the camshaft, wherein the enclosure chamber is formed by a case formed by an engine main body and a cover closing an opening face of the case tightly, the control valve is attached to the engine main body at a portion surrounded by the endless flexible member, the cover has an opening through which the control valve projects outside of the cover, and the case has an attachment section to which a periphery of the opening of the cover is touched tightly and fixed.

According to this invention, since the control valve is attached to the engine main body at a portion surrounded by the endless flexible member utilizing a dead space, the internal combustion engine can be made compact and arrangement of parts in the vicinity is not restrained.

Since the cover is fixed to the attachment section at a position surrounded by the endless flexible member, rigidity of the cover is made high to restrain the vibration and as the result, noise is reduced.

An attachment section to which a mount bracket of the internal combustion engine is fixed may be provided on the engine main body in a neighborhood of he control valve.

Since the mount bracket capable of restraining the engine vibration most is fixed to the vicinity of the control valve, vibration of the control valve is restrained, therefore use of a control valve coped with vibration is unnecessary, and the cost can be reduced.

In the above-mentioned enclosure chamber, the control valve may be attached to a cylinder head constituting a part of the engine main body, the attachment section may be formed on the cylinder head, an end of the cover may touch a seal member of a resilient material fixed to a cylinder head cover constituting a part of the case, and another end of the cover may be fixed to an oil pan constituting a part of the case.

Because an end of the cover is supported from the cylinder head cover by means of the resilient seal member and another end of the cover is fixed to the oil pan, a membranous vibration is generated on the cover. This membranous vibration is apt to be generated most at a portion opposite to the cylinder head. However, the cover is fixed to the attached section at the portion, so that the vibration is restrained efficiently and therefore noise is reduced more.

DETAILED DESCRIPTION OF THE PREFERRED EMBODIMENT

Hereinafter, a preferred embodiment of the present invention will be described with reference to FIGS. 1 to 4.

In this embodiment, the internal combustion engine 1 is a spark-ignition DOHC type four-cylinder engine mounted on a vehicle with a crankshaft directed in right-left direction of the vehicle.

Figure 1:
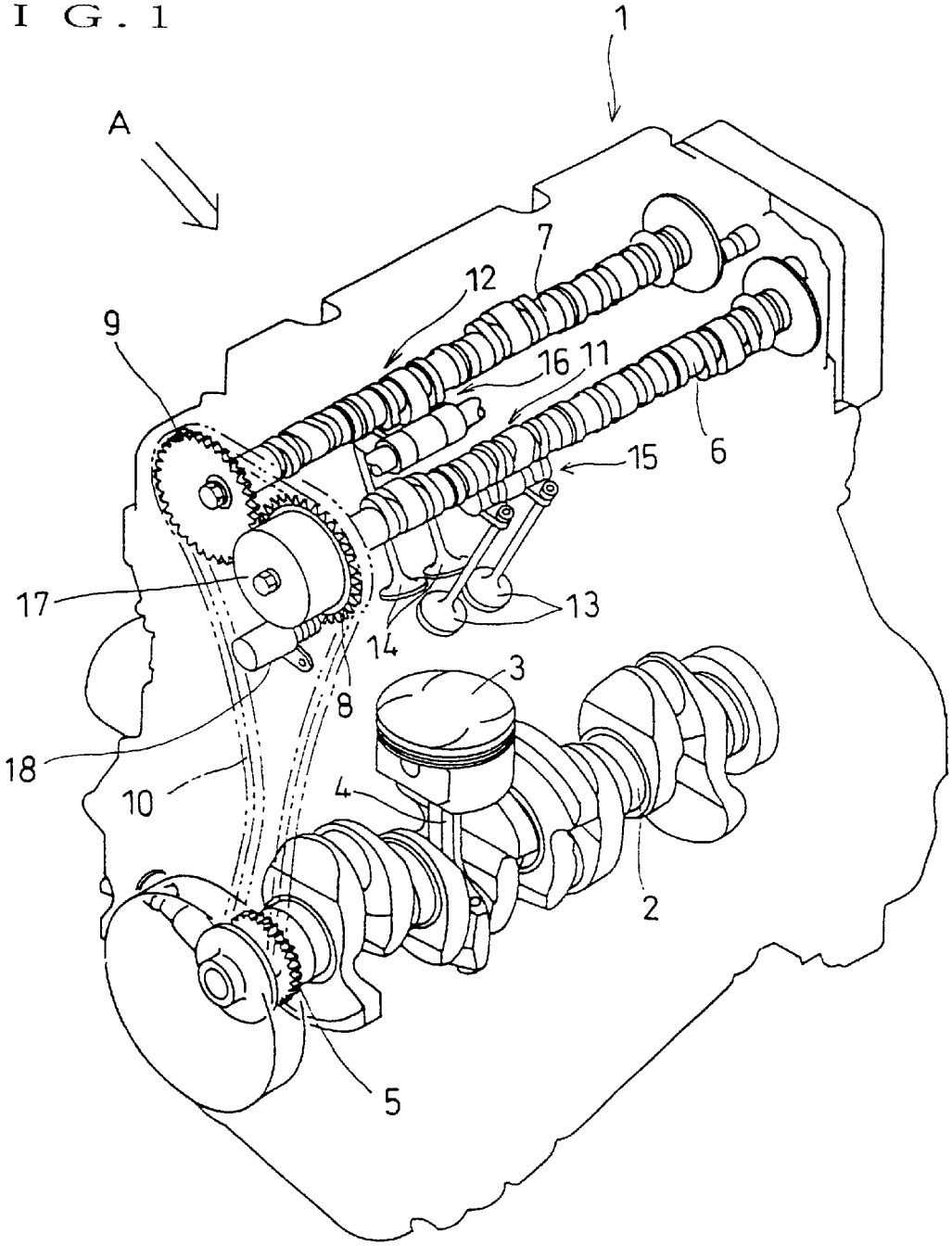
FIG. 1 is a schematic whole view of an internal combustion engine applied with the present invention.

Referring to FIG. 1, a piston 3 fitted slidingly in a bore of a cylinder is connected to the crankshaft by means of a connecting rod 4 for transforming reciprocation of the piston 3 to rotation of the crankshaft 2. A drive sprocket 5 is provided at a right end (left end in FIG. 1) portion of the crankshaft 2 and a suction cam sprocket 8 and an exhaust cam sprocket 9 are provided at respective right end portions of a suction camshaft 6 and an exhaust camshaft 7 which are disposed in parallel with each other. A timing chain 10 (a camshaft driving endless flexible member) is wound round the sprockets 5, 8, 9 so that the camshafts 6, 7 rotate one revolution during the crankshaft 2 rotates two revolutions.

In this description, "front", "rear", "right" and "left" are expressed with respect to one who rides on the vehicle with the engine mounted and looks toward the front of the vehicle. In FIG. 1, the arrow A shows traveling direction of the vehicle.

Each cylinder has a suction valve 13 and an exhaust valve 14 which are called collectively as engine valves. In this embodiment, each cylinder has a pair of the suction valves 13 and a pair of the exhaust valves 14. The suction valves 13 are driven by a plurality of suction rocker arms which are rocked by a plurality of suction cams of different profiles provided on the suction camshaft. A suction side first valve characteristic control mechanism 15 is provided for altering lift and opening period of the suction valves 13. The first valve characteristic control mechanism 15 includes a connection changing mechanism which connects and disconnects the suction rocker arms by means of a pin operated by oil pressure.

Similarly, the exhaust valves 14 are driven by a plurality of exhaust rocker arms which are rocked by a plurality of exhaust cams of different profiles provided on the exhaust camshaft. An exhaust side first valve characteristic control mechanism 16 is provided for altering lift and opening period of the exhaust valves 14. The exhaust side first valve characteristic control mechanism 16 includes a connection changing mechanism which connects and disconnects the exhaust rocker arms by means of a pin operated by oil pressure.

Working oil pressure in each of the first valve characteristic control mechanisms 15, 16 is controlled by a first oil pressure control valve (not shown). Namely, in a low speed region of the engine, the first oil pressure control valve is connected with a drain passage 54 (FIG. 3) to occupy a low oil pressure position, so that the connection changing mechanism is supplied with working oil of low pressure, and the suction and exhaust rocker arms are disconnected to drive the suction valves 13 and the exhaust valves 14 with a small lift and a short opening period adapted for the low speed region of the engine. The drain passage 54 opens to a chain chamber 61 for lubricating the chain.

In a high speed region of the engine, the first oil pressure control valve closes the drain passage 54 and communicates with a working oil supply source to occupy a high oil pressure position, so that the connection changing mechanism is supplied with working oil of high pressure, and the suction and exhaust rocker arms are connected to drive the suction valves 13 and the exhaust valves 14 with a large lift and a long opening period adapted for the high speed region of the engine.

On the right end portion of the suction camshaft 6 having the suction cam sprocket 8 is provided a second valve characteristic control mechanism which advances or retards opening-closing time of the suction valve 13 continuously with respect to the crankshaft 2 to alter the cam phase. And a second oil pressure control valve 18 for controlling oil pressure in the second valve characteristic control mechanism 17 is disposed inside of the looped timing chain 10.

Figure 2:
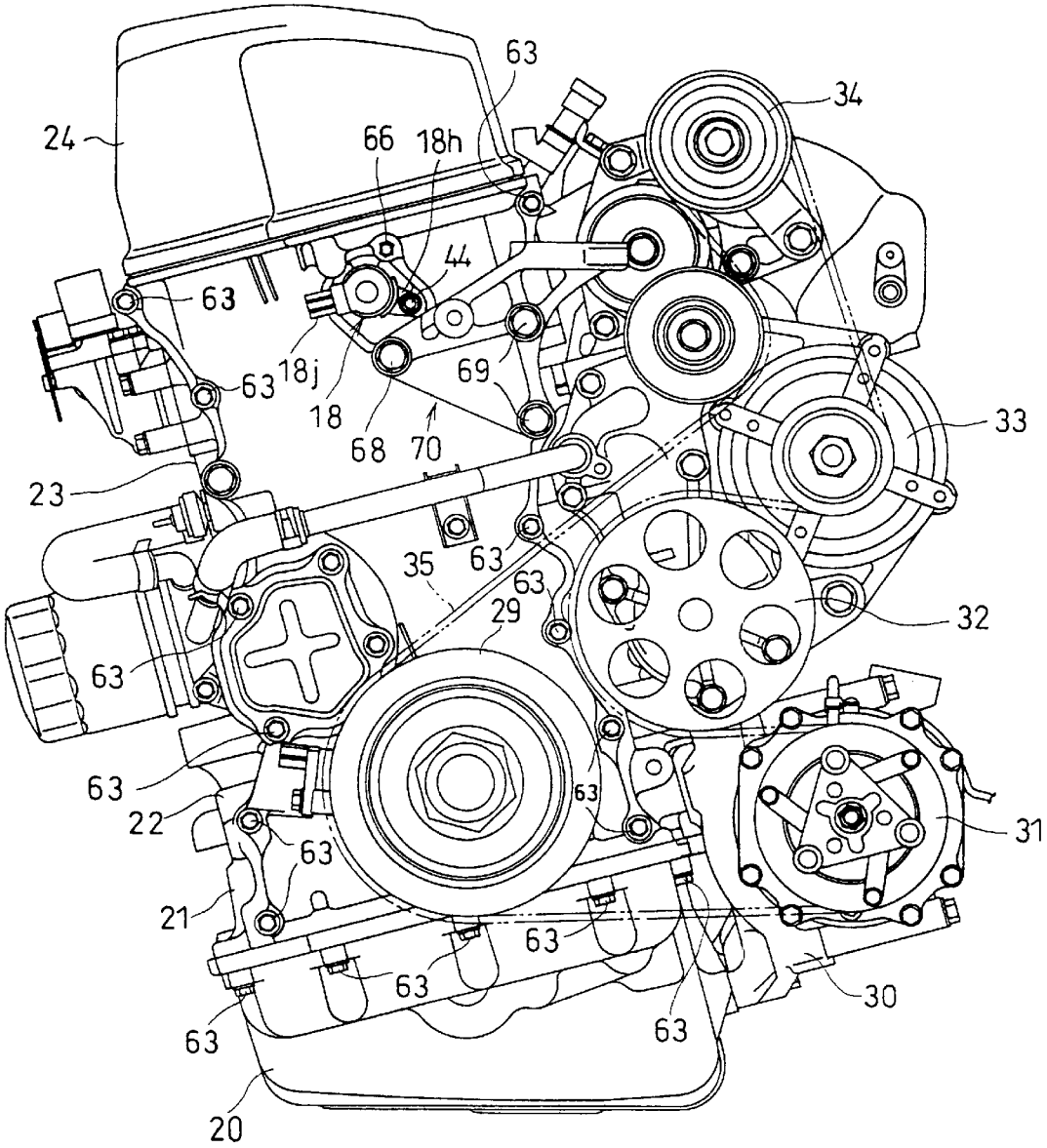
FIG. 2 is a right side view of the internal combustion engine.
Figure 3:
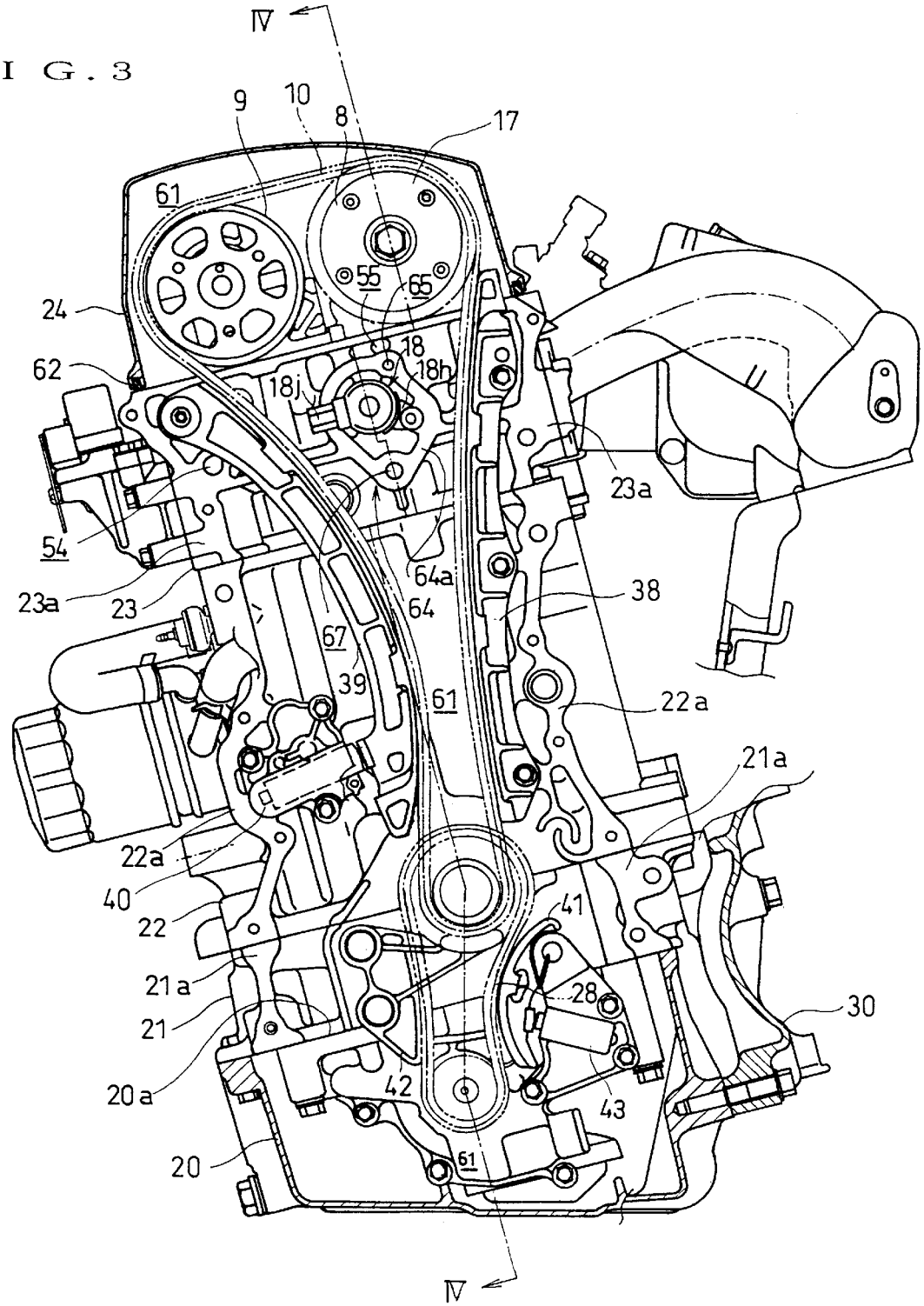
FIG. 3 is a partial sectional view of the internal combustion engine with a cover removed.
Figure 4:
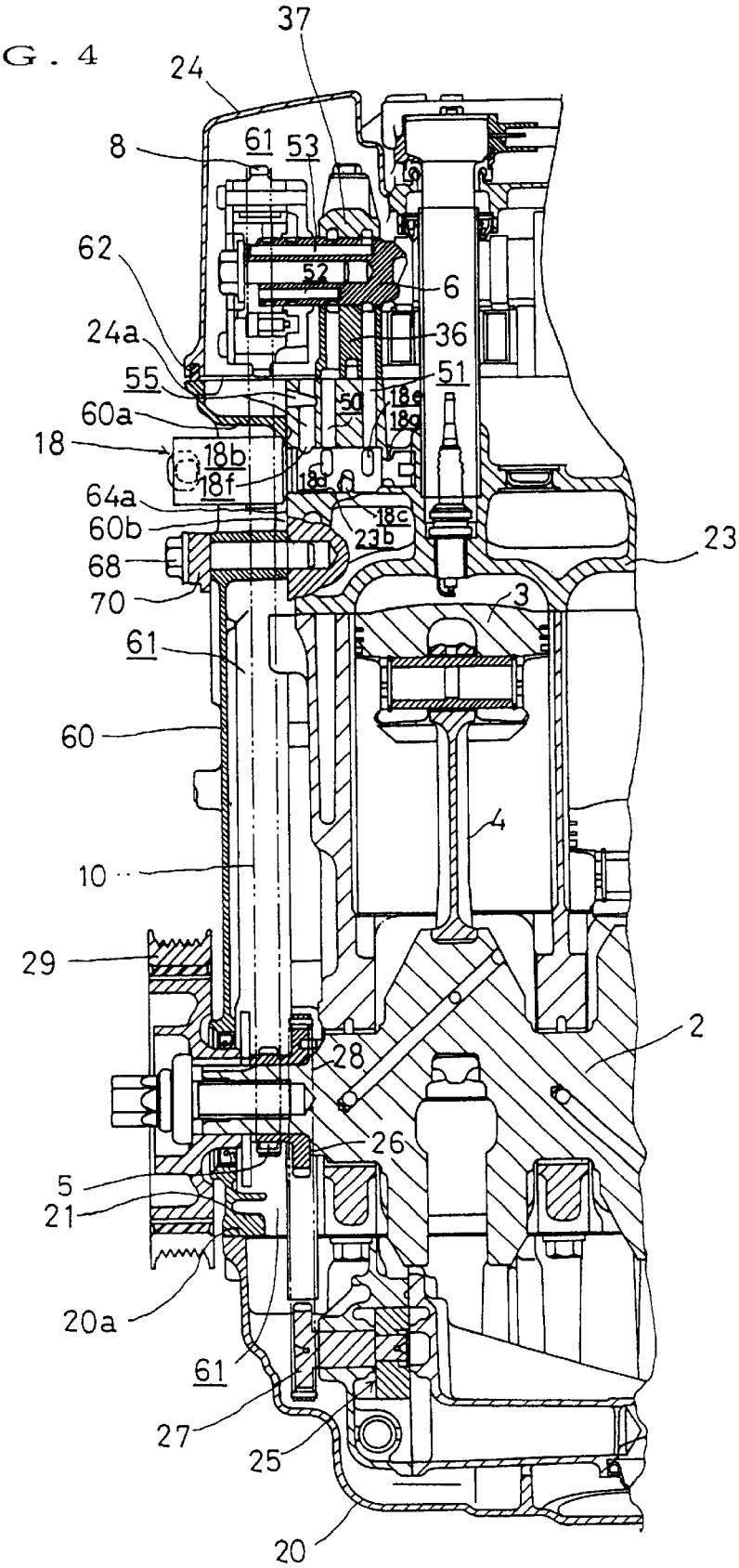
FIG. 4 is a sectional view taken along the line IV—IV of FIG. 3.

As shown in FIGS. 2 to 4, the crankshaft 2 is supported on a contact surface between a cylinder block 22 and a lower block 21. An oil pan 21 is assembled on a lower end surface of the lower block 21. The cylinder head 23 is assembled on an upper end surface of the cylinder block 22, and a cylinder head cover 24 is assembled on an upper end surface of the cylinder head 23.

On the right end portion of the crankshaft 2 are attached the above-mentioned drive sprocket 5 and a sprocket 26 for driving an oil pump 25 so as to rotate together with the crankshaft2. The sprockets 5, 26 are formed as one body. A driven sprocket 27 is formed on the shaft of the pump 25 integrally so that the oil pump 25 is driven by a chain 28 wound round the sprockets 26, 27.

The right end of the crankshaft 2 penetrates a cover 60 through a sealing member and auxiliary machinery driving pulley 29 is attached to the end on the outside of the cover 60 by a bolt to drive a compressor 31, a cooling water pump 32, an alternator 33 and an oil pump 34 for power steering which are attached to a bracket 30 fixed on a front surface of the engine main body, by means of a belt 35 (FIG. 2) On the cylinder head 23 are put rocker shaft holders 36 at both ends of the row of cylinder and between the cylinders. The rocker shaft holder 36 is provided with a suction rocker shaft supporting suction rocker arms for rocking motion and an exhaust rocker shaft supporting exhaust rocker arms for rocking motion. Further, on each rocker shaft holder 36 is put a corresponding cam holder 37. The rocker shaft holder 36 and the cam holder 37 are fixed to the cylinder head 23 by bolts. The suction and exhaust camshafts 6, 7 are supported in circular holes each having a lower semi-cylindrical support surface formed on an upper surface of the rocker shaft holder 36 and an upper semi-cylindrical support surface formed on a lower surface of the corresponding cam holder 37.

On the front and rear sides of the timing chain are provided respective chain guides 38, 39 (FIG. 3). The chain guide 39 on the rear side is pressed by a tensioner 40. Similarly, the pump driving chain 28 has a chain guide 42 on the rear side and a chain guide 41 on the front side pressed by a tensioner 43.

The second oil pressure control valve 18 is attached on a right end surface of the cylinder head 23 positioned inside of the loop of the timing chain 10 and on the side of the suction camshaft 6 with respect to the axis of the cylinder bore. The second oil pressure control valve is inserted in an insertion hole 23*b* formed in the cylinder head 23.

The second oil pressure control valve 18 has a cylindrical sleeve 18*a* inserted into the insertion hole 23*b*, a spool (not shown) fitted in the sleeve 18*a* for sliding motion, and a duty solenoid 18*b* positioned outside of the cylinder head 23 and fixed to the sleeve 18*a* to drive the spool. By duty controlling electric current supplied to the duty solenoid 18*b*, axial position of the spool is changed continuously and pressure of the working oil supplied to the second valve characteristic control mechanism 17 is controlled continuously. A tip end of the sleeve 18*a* penetrates the insertion hole 23*b* to project into a space formed in the cylinder head 23.

The sleeve 18*a* is formed with a central inlet port 18*c* communicating with the working oil supply source, an advance port 18*d* and a retard port 18*e* positioned on both sides of the inlet port 18*c* respectively, and a pair of drain ports 18*f*, 18*g* positioned respective outsides of the ports

18*d,* 18*e*. The duty solenoid 18b has an attachment bracket 18*h* for fixing the second oil pressure control valve 18 to the cylinder head 23 by a bolt 44, and a connector 18*j* for connecting a signal line leading to an electronic control unit.

An advance side oil passage 50 and a retard side oil passage 51 extend from the second oil pressure control valve 18 to the second valve characteristic control mechanism 17. The advance side oil passage 50 extends from the advance port 18*d* upward within the cylinder head 23 and the rocker shaft holder 36, then along a surface contacted with the cam holder 37, and along an annular passage formed on a periphery of the suction camshaft 6 by a lower support surface of the rocker shaft holder 36 and an upper support surface of the cam holder 37.

The retard side oil passage 51 extends from the retard port 18*e* upward within the cylinder head 23 and the rocker shaft holder 36, then along a surface of the rocker shaft holder 36 contacted with the cam holder 37, and further along an annular passage formed on a periphery of the suction camshaft 6 by a lower support surface of the rocker shaft holder 36 and an upper support surface of the cam holder 37.

In the second valve characteristic control mechanism 17, four vanes are formed integrally with the suction camshaft 6 and an advance chamber and a retard chamber are formed on both sides of the each vane.

The advance side oil passage 50 communicates with a pair of oil passages for advance 52 which communicate with the advance chamber through an annular oil passage formed on a periphery of the suction camshaft 6 and four oil passages formed in the second valve characteristic control mechanism 17.

Similarly, the retard oil passage 51 communicates with a pair of oil passages for retard 53 which communicate with the retard chamber through an annular oil passage formed on a periphery of the suction camshaft 6 and four oil passages formed in the second valve characteristic control mechanism 17.

The second oil pressure control valve 18 controls pressure of the working oil in accordance with a signal from an electronic control unit so that the cam phase coincides with a target cam phase set corresponding to an engine rotational speed and an engine load. Namely, in order to advance the cam phase, the spool of the second oil pressure control valve 18 is moved to connect the inlet port 18*c* with the advance port 18*d* so that a controlled working oil reaches the advance chambers from the advance port 18*d* through the advance side oil passage 50 and related oil passages.

On the one hand, the retard port 18*e* and the drain port 18*g* of the second oil pressure control valve 18 are connected with each other, so that the working oil in the retard chamber is discharged into a space formed in the cylinder head 23 through related oil passages, the retard side oil passage 51, the retard port 18*e* and the drain port 18*g* provided on the tip end of the sleeve 18*a*. As the result, the vane rotates owing to pressure difference between the advance chamber and the retard chamber, so that the suction camshaft 6 rotates relatively to the suction cam sprocket 8 to advance the cam phase.

Similarly, in order to retard the cam phase, the spool of the second oil pressure control valve 18 is moved to connect the inlet port 18*c* with the retard port 18*e* so that a controlled working oil reaches the retard chambers from the retard port 18*e* through the retard side oil passage 51 and related oil passages.

On the one hand, the advance port 18*d* and the drain port 18*f* of the second oil pressure control valve 18 are connected with each other, so that the working oil in the advance chambers is discharged into a chain chamber 61 through related passages, the advance side oil passage 50, the advance port 18*d,* the drain port 18*f* and a drain passage 55 formed in the cylinder head. As the result, the vane rotates owing to pressure difference between the retard chamber and the advance chamber, so that the suction camshaft 6 rotates relatively to the suction cam sprocket 8 to retard the cam phase.

When an actual cam phase coincides with the target cam phase, the spool is moved to a neutral position where the advance port 18*d* and the retard port 18*e* are intercepted from the inlet port 18*c* and the drain ports 18*f,* 18*g,* and the cam phase is held.

The drive sprocket 5, the suction cam sprocket 8, the exhaust sprocket 9 and the timing chain 10 are enclosed in the chain chamber (enclosure chamber) 61 which is covered by the cylinder head cover 24, the oil pan 30 and a cover attached to the right ends of the cylinder head 23 and the cylinder block 22. The suction and exhaust cam sprockets 8, 9 are covered by the cylinder head cover 24, and the chains 10, 28 are covered by the cover 60.

In this embodiment, the cylinder head cover 24, the cylinder head 23, the cylinder block 22, the lower block 21 and the oil pan 20 constitute an engine main body and an end portion of the engine main body near the timing chain 10 constitutes a case of the chain chamber 61. Opened end faces of the cylinder head cover 24, cylinder head 23, the cylinder block 22, the lower block 21 and the oil pan 20 form a opening of the case. Namely, a downward opened end surface 24*a* of the cylinder head cover 24, rightward opened end faces 23*a,* 22*a,* 21*a* of the cylinder head 23, the cylinder block 22 and the lower block 21, and upward opened end face 20*a* of the oil pan 20 form an opening of the case, and a cover 60 is attached to the opened end faces in liquid-tight.

More concretely, the cover 60 is touched close to a resilient material, a seal member 62 of rubber for example, fitted on the downward opened end face 24*a* of the cylinder head cover 24 and fixed to the rightward opened end surfaces 23*a,* 22*a* and 21*a* of the cylinder head 23, the cylinder block 22 and the lower block 21 and to the upward opened end face 20*a* of the oil pan 20 by bolts arranged along the open end faces 20*a,* 21*a,* 22*a* and 23*a*.

An attachment section 64 is formed surrounding the insertion hole 23*b* of the cylinder head and the second oil pressure control valve fitted to the insertion hole 23*b,* and the cover 60 is touched close to the attachment surface 64*a* of the attachment section too, and fixed by a bolt 64 engaging with a tapped hole 65 formed at the attachment surface 64*a*. The cover 60 has a cylindrical opening 60*a* which the second oil pressure control valve 18 passes through so as to project outside of the chain chamber 61, and a whole marginal edge of the opening 60*a* on the side of the cylinder head 23 touches the attachment surface 64*a* in liquid-tight. Therefore, also the attachment surface 64*a* of the attachment section 64 constitutes a part of the opened end surface of the case forming the chain chamber 61.

Another tapped hole 67 is formed on the attachment section 64, and a bolt 68 is screwed in the tapped hole 67 for fitting a mount bracket 70 of the engine 1 and the cover 60 together. Thus the attachment section 64 is a fixing section of the mount bracket 70 to the engine main body. Further, the mount bracket 70 is fixed to the rightward opened end face 23*a* of the cylinder head 23 together with the cover 60 by two bolts 69.

When the engine is operated, the suction valves 13 and the exhaust valves 14 of each cylinder are driven, with a small lift and a short opening period in case of the engine low speed region or with a large lift and a long opening period in case of the engine high speed region, by the first valve characteristic control mechanisms 15, 16 operated in accordance with working oil pressure controlled by the first oil pressure control valve.

On the one hand, the second valve characteristic control mechanism 17 operated in accordance with working oil pressure controlled by the second oil pressure control valve 18 controls opening-closing time of the suction valve 13 so that the actual cam phase coincides with a target cam phase set in accordance with an engine rotational speed and an engine load.

The second oil pressure control valve 18 is attached to the cylinder head 23 at inner side of the looped timing chain 10 utilizing a dead space, so that the engine 1 can be made compact and arrangement of parts around the engine is not restrained.

Though the second oil pressure control valve 18 is provided inside of the looped timing chain 10, the marginal edge 60*b* of the opening 60*a* of the cover 60 is wholly touched to the attachment surface 64*a* of the attachment section 64 formed on the engine cylinder head in liquid-tight. Therefore, the second oil pressure control valve 18 is positioned outside of the chain chamber 61 isolated from an oily atmosphere within the chain chamber 61. As the result, no oil-proof control valve is necessitated for the second oil pressure control valve 18 and the cost can be reduced.

Since the second oil pressure control valve 18 is positioned outside of the chain chamber 61 and does not exposed to a high temperature atmosphere compared with a case that it is positioned within the chain chamber 61, no expensive control valve coped with high temperature is necessary and the cost can be reduced in this respect too. Since the duty solenoid 18*b* is positioned outside of the chain chamber 61, a temperature rise of the second oil pressure control valve 18 owing to electric current of the duty solenoid 18*b* can be lowered by air-cooling.

Since the cover 60 is fixed to the attachment section 64 positioned inside of the timing chain 10 by the bolt 66, rigidity of the cover 60 is increased so that vibration and noise are restrained.

To the attachment section 64 is fixed the mount bracket 70 which restrains vibration of the engine 1 most, therefore vibrations of the cover 60 and the second oil pressure control valve 18 are restrained so that an expensive control valve coped with vibration is unnecessary as the second oil pressure control valve 18 and the cost can be reduced.

Because an end of the cover 60 is supported from the cylinder head cover 24 constituting the engine main body by means of the seal member 62 of a resilient material and another end of the cover is fixed to the oil pan 20 constituting the engine main body and the case of the chain chamber 61, a membranous vibration is generated on the cover 60. This membranous vibration is apt to be generated most at a portion opposite to the cylinder head 23. However, since the cover 60 is fixed to the attachment section 64 at the above-mentioned portion, the vibration is restrained effectively and therefore noise is restrained. Moreover, since the cover 60 is fixed to the attachment section 64 together with the mount bracket 70 by the bolt, vibration of the cover 60 is restrained more.

Working oil discharged from the drain passage 55 to a portion above the attachment section 64 is divided into front and rear flows along the periphery of the attachment section 64, so that a front side and a rear side of the timing chain 10 can be lubricated equally.

pressure control valve 18 is provided inside of the timing chain 10, however the first oil pressure control valve may be provided inside of the timing chain 10, in place of the second oil pressure control valve 18.

Though the second valve characteristic control mechanism 17 is provided on the suction camshaft 6 in the above-mentioned embodiment, the second valve characteristic control mechanism 17 may be provided on the exhaust camshaft 7 or on both the suction camshaft 6 and the exhaust camshaft 7. Further, the engine 1 may have a single camshaft formed with a suction cam and an exhaust cam integrally.

Though the mount bracket 70 is fixed to the attachment section 64 formed around the second oil pressure control valve 18 in the above-mentioned embodiment, the mount bracket 70 may be fixed to a neighborhood of the second oil pressure control valve 18 other than the attachment section 64. The fixing position is decided suitably in view of influence of vibration to the second oil pressure control valve 18 and prevention of the membranous vibration of the cover 60.

What is claimed is:

1. An enclosure chamber for a camshaft driving endless flexible member of an internal combustion engine having a camshaft for driving an engine valve, a hydraulic valve characteristic control mechanism for altering operational characteristic of the engine valve, a control valve for controlling pressure of operating oil supplied to the valve characteristic control mechanism, and the camshaft driving endless flexible member laid between the camshaft and a crankshaft to transmit torque of the crankshaft to the camshaft, wherein said enclosure chamber is formed by a case formed by an engine main body and a cover closing an opening face of said case tightly, said control valve is attached to said engine main body at a portion surrounded by said endless flexible member, said cover has an opening through which said control valve projects outside of said cover, and said case has an attachment section to which a periphery of said opening of the cover is touched tightly and fixed.

2. An enclosure chamber for a camshaft driving endless flexible member as claimed in claim 1, wherein an attachment section to which a mount bracket of the internal combustion engine is fixed is provided on said engine main body in a neighborhood of said control valve.

3. An enclosure chamber for a camshaft driving endless flexible member as claimed in claim 1 or 2, wherein said control valve is attached to a cylinder head constituting a part of said engine main body, said attachment section is formed on said cylinder head, an end of said cover touches a seal member of a resilient material fitted to a cylinder head cover constituting a part of said case, and another end of said cover is fixed to an oil pan constituting a part of said case.

* * * * *

UNITED STATES PATENT AND TRADEMARK OFFICE

CERTIFICATE OF CORRECTION

PATENT NO. : 6,308,673 B1
DATED : October 30, 2001
INVENTOR(S) : Toshiki Kobayashi It is certified that error appears in the above-identified patent and that said Letters Patent is hereby corrected as shown below:

Title page,
Please change the following information:
Item "[75] Inventor: Tosihiki Kobayashi , Wako (JP)"
to -- [75] Inventor: Toshiki Kobayashi , Wako (JP) --

Signed and Sealed this

Ninth Day of April, 2002

*Attest:*

*Attesting Officer*

JAMES E. ROGAN
*Director of the United States Patent and Trademark Office*